United States Patent [19]

Osborne

[11] 4,127,005

[45] Nov. 28, 1978

[54] RISER/JACKET VERTICAL BEARING ASSEMBLY FOR VERTICALLY MOORED PLATFORM

[75] Inventor: Bodwell D. Osborne, Atherton, Calif.

[73] Assignee: Standard Oil Company (Indiana), Chicago, Ill.

[21] Appl. No.: 720,478

[22] Filed: Sep. 3, 1976

[51] Int. Cl.[2] ..... B63B 35/44

[52] U.S. Cl. ..... 405/227; 114/265; 175/7

[58] Field of Search ..... 61/94, 90, 91; 114/264, 114/265; 175/7

[56] References Cited

U.S. PATENT DOCUMENTS

| | | | |
|---|---|---|---|
| 2,954,676 | 10/1960 | Guy et al. | 61/91 |
| 3,259,368 | 7/1966 | Warnke | 61/91 X |
| 3,976,021 | 8/1976 | Blenkarn et al. | 61/89 |

*Primary Examiner*—Jacob Shapiro
*Attorney, Agent, or Firm*—John D. Gassett

[57] ABSTRACT

This invention relates to a vertically moored platform which is a floating structure anchored only by essentially parallel and vertical elongated members such as riser pipes under tension. Up to 32 or more such riser pipes are connected between the floating structure and anchor means on the sea floor. Special riser pipe/jacket vertical bearing assembly is provided to place the riser pipes under proper tension and to transmit force from the riser pipes to the floating structure.

3 Claims, 3 Drawing Figures

RISER/JACKET VERTICAL BEARING ASSEMBLY FOR VERTICALLY MOORED PLATFORM

BACKGROUND OF THE INVENTION

Field of the Invention

This invention relates to a floating structure from which drilling or production operations are carried out. It relates especially to the installation of Vertically Moored Platforms in deep water.

In recent years, there has been considerable attention attracted to the drilling and production of wells located in water. Wells may be drilled in the ocean floor from either fixed platforms in relatively shallow water or from floating structure or vessels in deeper water. The most common means of anchoring fixed platforms includes the driving or otherwise anchoring of long piles in the ocean floor. Such piles extend above the surface of the water and support a platform attached to the top of the piles. This works fairly well in shallow water, but, as the water gets deeper, the problems of design and accompanying costs become prohibitive. In deeper water, it is common practice to drill from a floating structure.

In recent years, there has been some attention directed toward many different kinds of floating structures. One system receiving attention for mooring is the so-called Vertically Moored Platform. Such a platform is described in U.S. Pat. No. 3,648,638, issued Mar. 14, 1972, Kenneth A. Blenkarn, inventor. Key features of the disclosure in that patent are that the floating platform is connected to an anchor only by elongated parallel members and the floating structure has buoyancy means designed especially with respect to the trough of a design wave so as to minimize mooring forces imposed on the vertically elongated members which anchor the structure, such as those forces which may be caused by passing waves.

Pertinent prior art includes the aforesaid patent 3,648,638 and U.S. Pat. No. 3,976,021, issued Aug. 24, 1976, Kenneth A. Blenkarn and William D. Greenfield, inventors. However, the riser pipe/jacket vertical bearing described herein was not described in said patent 3,648,638. Further, it was not claimed in said patent 3,976,021, although described.

BRIEF DESCRIPTION OF THE INVENTION

This concerns a riser/jacket vertical bearing assembly connecting the upper end of a riser pipe to a Vertically Moored Platform. The lower end of the riser pipe is connected to anchor means on the floor of the body of water supporting the Vertically Moored Platform. The upper end of the riser pipe is provided with an external ring. The riser pipe extends vertically through an opening in the Vertically Moored Platform, which is provided with a horizontal bulkhead near such opening. There is provided a support bracket having, at its upper end, an internal groove complementing and surrounding the ring on the riser pipe. The lower end of the bracket is tapered outwardly and has a horizontal ring member and a horizontal shoulder member. A jack is provided between the bulkhead and the annular shoulder on the bracket for applying proper tension to the riser pipe through the support bracket. Shim plates are inserted between the horizontal ring member of the bracket and a bearing plate supported by the bulkhead.

A better understanding of the invention may be had from the following description taken in conjunction with the drawings.

DRAWINGS

DETAILED DESCRIPTION

Figure 1:
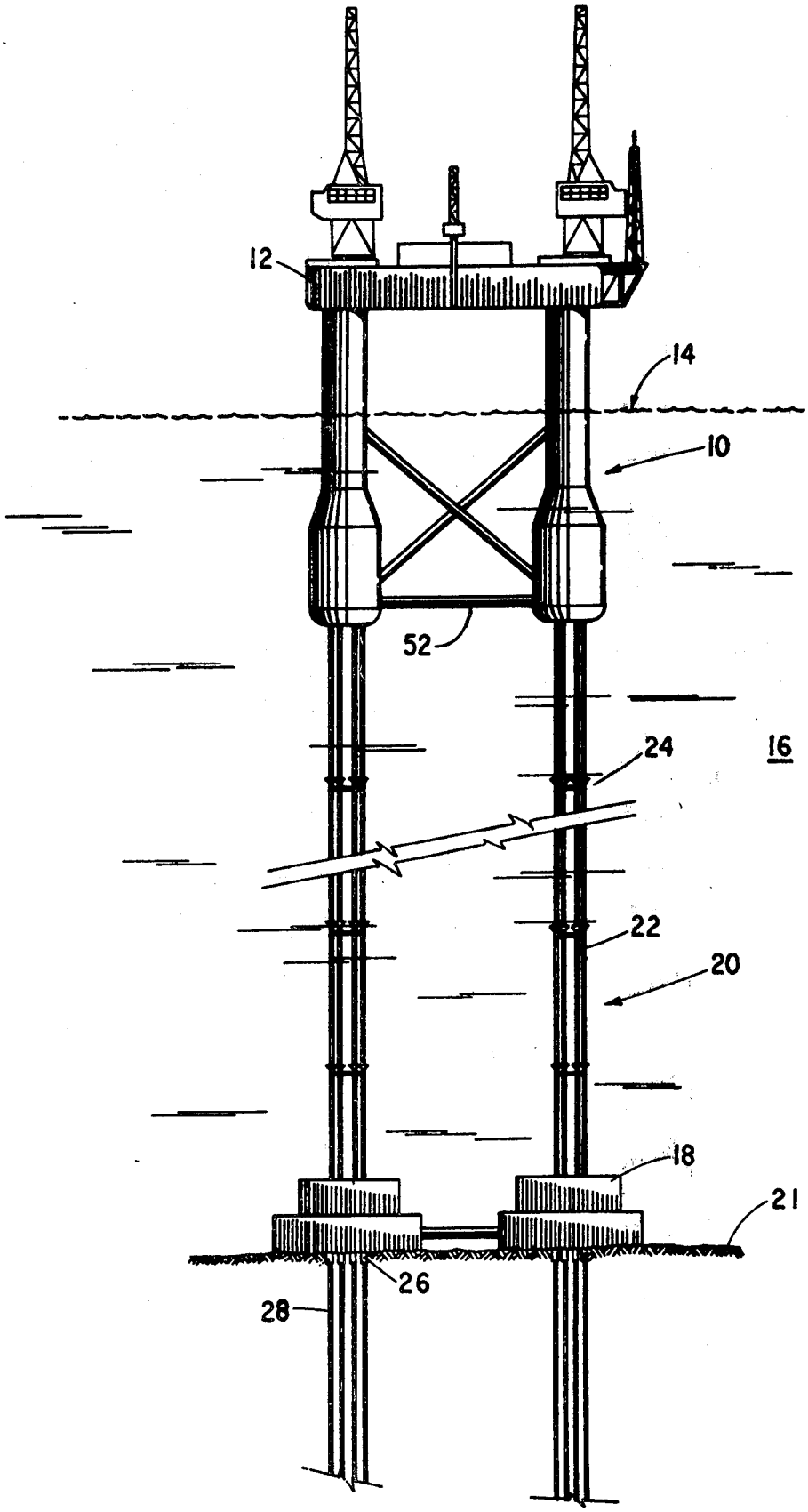
FIG. 1 illustrates a Vertically Moored Platform.

Attention is next directed to the drawings, and, in particular, FIG. 1, which illustrates a Vertically Moored Platform with gravity base and risers installed and ready for drilling. The gravity base is only one form of anchor means. There is shown a buoyancy means 10 supporting a deck 12 above the surface 14 of the body of water 16. The buoyancy means 10 is connected to gravity base 18 by four legs 20. Each leg 20 includes a plurality, in this case, eight, of riser pipes 22. Spacers 24 are provided vertically along each leg 20 to keep the riser pipes 22 apart and to modify their resonant frequency to prevent flutter. Each gravity base section 18 has a plurality of punch tubes 26 which are forced by the weight of the gravity base into the sea floor 21. Drive pipes 28 extend downwardly from punch tubes 26. After the Vertically Moored Platform is installed, as shown in FIG. 1, drilling operations are conducted through individual risers 22 from the top of platform 12. One method of installation of a Vertically Moored Platform is shown in the aforesaid patent 3,976,021.

Figure 2:
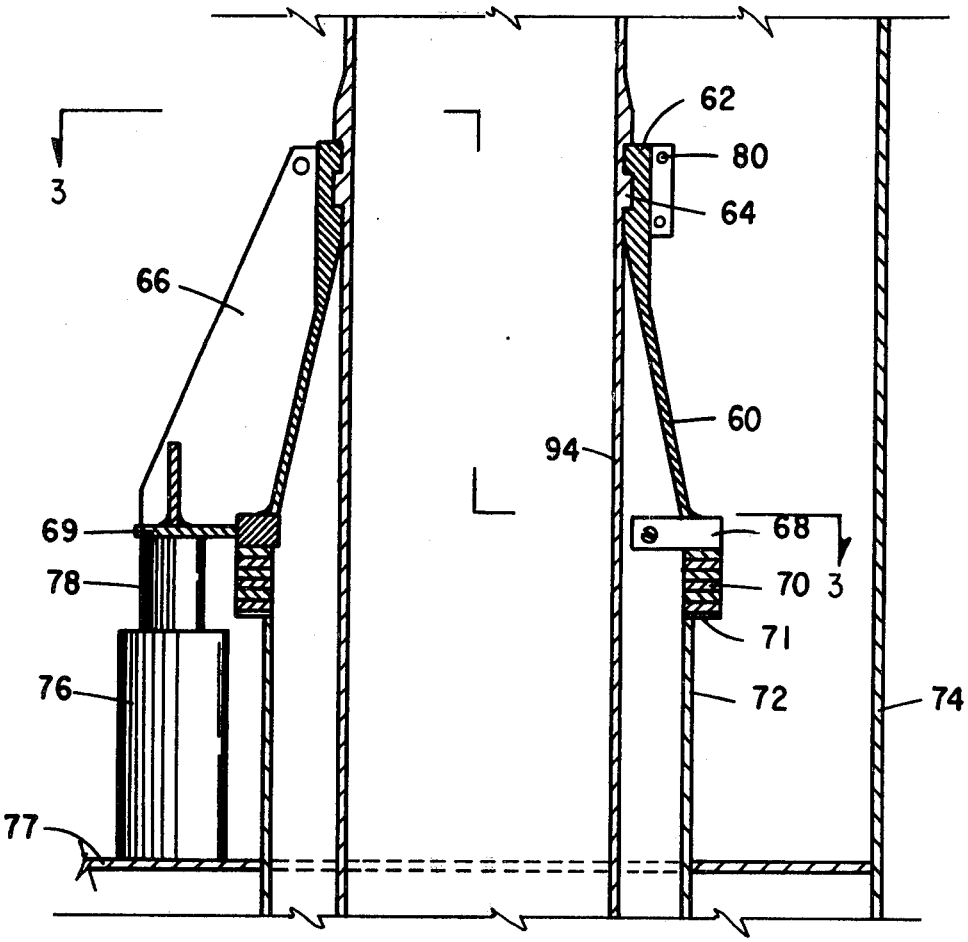
FIG. 2 is taken along the line 2—2 of FIG. 3 and illustrates a method of applying tension to the riser pipe and located within the buoyancy means.
Figure 3:
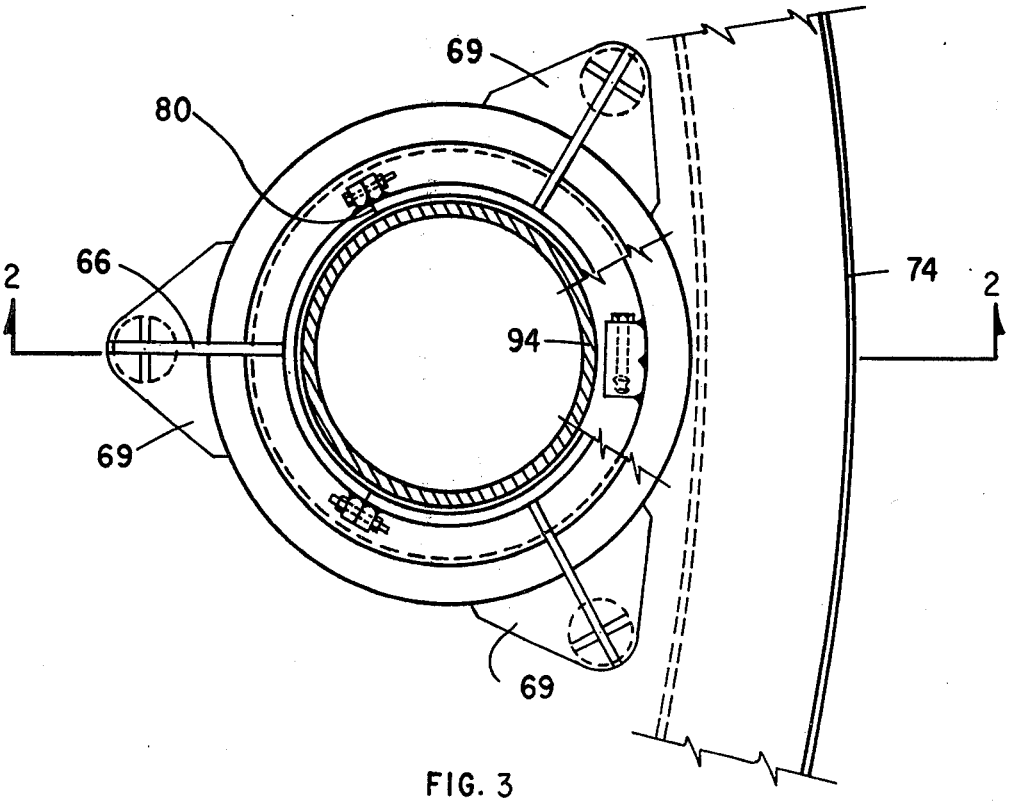
FIG. 3 is a view taken along the line 3—3 of FIG. 2.

Attention is now directed to FIGS. 2 and 3 which show means for applying tension to the riser pipes. By this system, I can adjust the tension as desired. Shown thereon, is the riser piper upper terminator or section 94 extending upwardly through jacket 74 which is a part of floating structure 10. An outer shoulder 64 is provided about the upper portion of the riser pipe section 94, shown in FIG. 2. A complementing support bracket 62 is mounted about ring 64. Bracket 62, as can be seen in FIG. 3, is made in three pieces and connected together by bolts or other connecting means 80. Element 62 extends downwardly in a tapered position to a ring member 68. 68 has three extensions or shoulders 69, as shown in FIG. 3. A jack 76, supported from bulkhead 77, which is supported from the jacket 74, is provided with a ram 78 for each shoulder 69. By applying force to jack 76, the risers can be pushed upwardly with respect to jacket 74. A bearing plate 71 is attached to upright member 72 which is attached to jacket 74. Shim plates 70 are provided between items 71 and 68. What occurs is that jacks 76 push the riser pipe upwardly with respect to the floating structure to obtain the desired tension on the riser pipe. Then a sufficient number of bearings 70 are inserted, and then the jack is backed off and the force is transmitted through the bearing plates 70. Proper tension is thus applied to riser pipes 94. All of the anchoring of the buoyancy means is through the riser pipes. It is well to point out that there are a plurality of riser pipes, typically eight, in each leg, of which typically there are four in the particular embodiment shown. In this configuration, there would normally be 32 riser pipes, all installed as discussed herein. Drilling and subsequent production operations can be conducted through each riser.

While the above description has been given in rather high detail, various modifications can be made without departing from the spirit or scope of the invention.

I claim:

1. A system for connecting the upper end of a tensioned riser pipe having an external ring to a floating structure which comprises:

a rigid bracket having an internal groove complementing and surrounding said external ring, said bracket tapering downwardly and outwardly and having a lower shoulder (69) and ring member (68), each essentially perpendicular to said riser pipe, a bulkhead (77) on said floating structure, a bearing plate (71) supported by said bulkhead, and a jack (76) between said bulkhead and said shoulder, said jack having a ram (78) extendible essentially parallel to said riser pipe so that axial tension can be applied to said riser pipe.

2. A system as defined in claim 1 including shim plates (70) between said bearing plate and said ring member.

3. A method of applying tension to a riser pipe anchoring a buoyant structure to the floor of a body of water which comprises:

providing an external ring on the upper end of said riser pipe;

placing a jack on the bulkhead of the said buoyant structure adjacent to the upper end of said riser pipe, said jack having a ram extendible only in a direction essentially parallel to the axis of said riser pipe;

placing a bracket on top of the ram of said jack, said bracket having an internal groove complementing and surrounding said external ring on said riser pipe, said bracket tapering downwardly and outwardly and having a lower shoulder sitting on the top of ram (78) of said jack;

applying tension to said riser pipe by extending said ram.

* * * * *